US011805812B1

(12) United States Patent
Nekos

(10) Patent No.: US 11,805,812 B1
(45) Date of Patent: Nov. 7, 2023

(54) NICOTINE CESSATION DEVICE AND METHOD OF USING SAME

(71) Applicant: Peter Michael Nekos, Katonah, NY (US)

(72) Inventor: Peter Michael Nekos, Katonah, NY (US)

( * ) Notice: Subject to any disclaimer, the term of this patent is extended or adjusted under 35 U.S.C. 154(b) by 725 days.

(21) Appl. No.: 16/782,781

(22) Filed: Feb. 5, 2020

Related U.S. Application Data

(60) Provisional application No. 62/801,134, filed on Feb. 5, 2019.

(51) Int. Cl.
*A24F 40/42* (2020.01)
*A24F 40/48* (2020.01)
*A24F 40/65* (2020.01)

(52) U.S. Cl.
CPC ..... *A24F 40/42* (2020.01); *A24F 40/48* (2020.01); *A24F 40/65* (2020.01)

(58) Field of Classification Search
CPC ..... A24F 40/42; A24F 40/48; A61M 15/0066
See application file for complete search history.

(56) References Cited

U.S. PATENT DOCUMENTS

2016/0337444 A1* 11/2016 Cameron ..... H04L 67/10
2019/0158938 A1* 5/2019 Bowen ..... H04M 1/72415
2019/0289909 A1* 9/2019 Hejazi ..... A24B 15/283
2020/0178607 A1* 6/2020 Blick ..... A61M 15/06
2020/0229508 A1* 7/2020 Israel ..... G16H 20/13
2020/0359684 A1* 11/2020 Bruton ..... A24F 40/485
2021/0268215 A1* 9/2021 Israel ..... A61M 11/042
2021/0401061 A1* 12/2021 Davis ..... A24F 40/57

FOREIGN PATENT DOCUMENTS

WO WO-2018069675 A1 * 4/2018 ..... A24F 1/12

* cited by examiner

*Primary Examiner* — Hae Moon Hyeon
(74) *Attorney, Agent, or Firm* — Dennis B. Danella, Esq.; Woods Oviatt Gilman LLP

(57) ABSTRACT

A system aids in the cessation of a nicotine dependency. The system has a nicotine cessation device having a device housing including a plurality of pod receiving sockets and a plurality of fluid pods. A respective fluid pod is removably coupled with a respective pod receiving socket of the plurality of pod receiving sockets. Each respective fluid pod of the plurality of fluid pods receives a nicotine fluid having a predetermined concentration of nicotine therein and each respective fluid pod receives a nicotine fluid concentration that is different than at least one other fluid pod. The device housing further includes a printed circuit board (PCB) including a processor and a memory, and a power source.

21 Claims, 12 Drawing Sheets

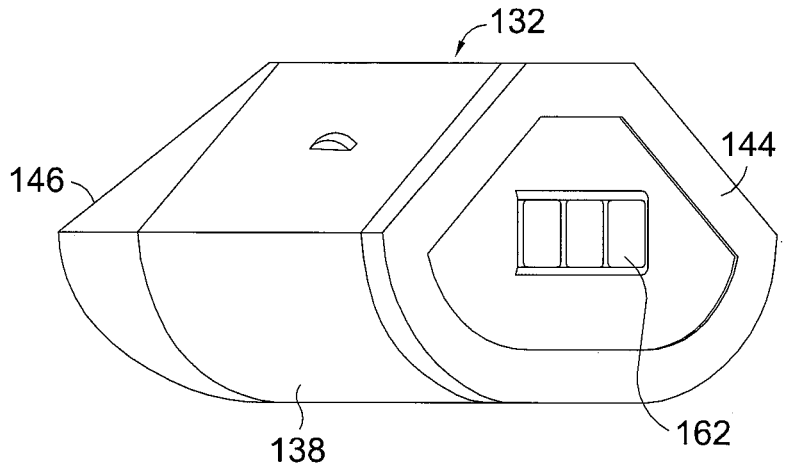
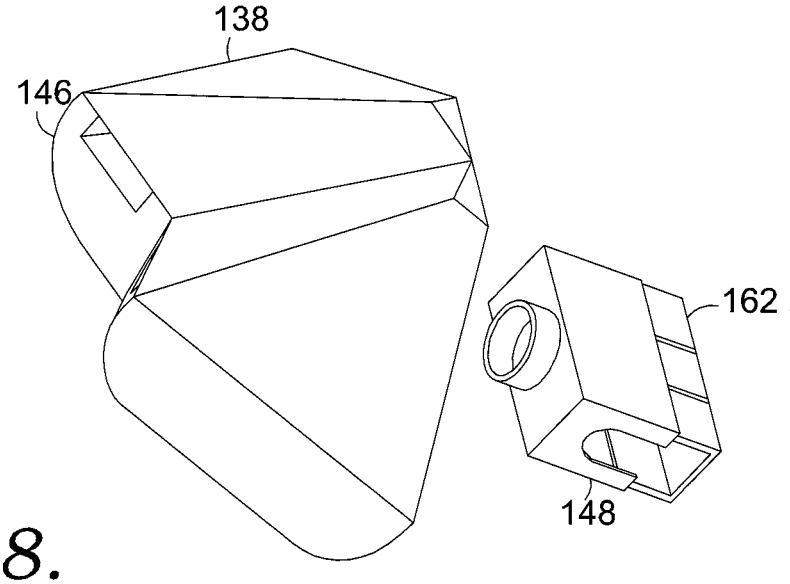
FIG. 8.
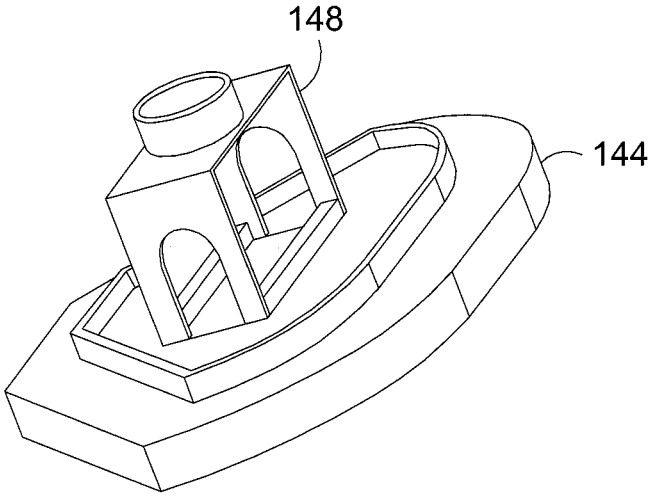

NICOTINE CESSATION DEVICE AND METHOD OF USING SAME

CROSS-REFERENCE TO RELATED APPLICATIONS

This application claims the benefit of U.S. Provisional Patent Application No. 62/801,134, filed Feb. 5, 2019, entitled TRIN, the entirety of each which is incorporated herein by reference.

FIELD OF THE INVENTION

The present invention relates to device and method to promote breaking of a nicotine addiction/dependency and encouraging cessation of smoking or vaping, and more particularly relates to a nicotine cessation device including a plurality of vaping pods wherein each pod has different nicotine concentration, and still more particularly to a method of employing the nicotine cessation device to systematically taper nicotine intake until nicotine is no longer consumed.

BACKGROUND OF THE INVENTION

Vaping is the inhaling of an aerosolized fluid (vapor) produced by an electronic cigarette (e-cigarette) or other similar device. Proponents argue that vaping produces a safer delivery of nicotine to its users than cigarettes. However the combination of flavor, elevated nicotine concentrations and lower price have increased the consumption and the population of adults and young adults consuming nicotine. As is known, nicotine is an addictive chemical commonly associated with cigarette smoking. While there is some question as to nicotine's carcinogenicity, nicotine is frequently inhaled with other known or suspected carcinogens, such as volatile organic compounds like acetaldehyde, formaldehyde and toluene, and heavy metals like cadmium and lead.

Nicotine patches and nicotine gum are used by many people to break their addiction/dependency. Nevertheless, some people still find it difficult to break their addiction through the continued use of conventional methods of breaking an addiction. Moreover, breaking a nicotine addiction increases in difficulty as the consumer's resistance increases when accustomed to higher consumption rates of nicotine. By way of example, someone who smokes one cigarette per day has a significantly easier time breaking the nicotine addiction than someone who smokes four cigarettes per day.

According to the Centers for Disease Control and Prevention (CDC) based on 2018 statistics, of the 248 million adults in the United States, 17% are smokers. This is down from 21% which was measured 15 years ago. Of the 28 million young adults aged 12-18, 6% smoke tobacco (about 1.7 million young adults between 12 and 18 years old). Of the 16 million young adults aged 15-18 (high school aged), 25% vape (about 4 million between 15 and 18 years old). Moreover, an average cigarette provides about 12 mg of nicotine during its use, with the average ingestion by the consumer of about 1.1-1.8 mg of nicotine. Thus, for each pack of cigarettes, the user will inhale between 22-36 mg of nicotine. An average adult consumer smokes about 1100 cigarettes per year, which comes out to about 3 cigarettes per day and approximately 4.5 mg nicotine/day. In contrast, typically available vape juice has a nicotine concentration of about 5% nicotine. Thus, a typically available vape juice pod containing about 1 milliliter of vape juice will deliver about 50 mg of nicotine. This is more than 2× the nicotine available in a pack of cigarettes. Moreover, the average vape user consumes a pod every three days. This means that the average vape user is consuming about 16.67 mg nicotine/day, which is 4× that of cigarette users. Consequently, while it appears that safer delivery of addictive nicotine exists in atomized/vaporized e-cigarettes when compared to tobacco cigarettes, vaping is leading to a greater percentage of the young adult population becoming addicted to nicotine, with such addiction being exponentially more difficult to overcome.

Therefore, there is a need for a system and method that provides a safe delivery of lower nicotine concentrations, while incorporating psychological and sociological positive reinforcement training to support the reduction of nicotine consumption as a Nicotine Replacement Therapy (NRT), with the ultimate aim to free a user from their nicotine dependency. The present invention addresses these as well as other needs.

BRIEF SUMMARY OF THE INVENTION

Similar to a substitute healthier snack in a diet program, one aspect of the present invention is to provide smokers and vapers an equivalent to diet portions by providing two alternate vape options in a single vape appliance. In one aspect, an exemplary nicotine cessation system in accordance with the present invention may include: a vape device/appliance; frontend software, such as a mobile application ("app") compiled for iPhone IOS and/or Android operating systems for use with a mobile electronic device like a smartphone, tablet computer, smartwatch, etc. (collectively referred to herein as a "phone" or "smartphone"); vape juice/fluid comprising blends in various dilutions of nicotine; vape pods which contain the vape juice; backend software, such as an internet server side program, data storage and user dispensing program capable of analytics processing; and, optionally, a subscription service that accompanies the use of the appliance and pods.

In one exemplary scenario, to begin using an embodiment of the system, a user can download the frontend software (i.e., the app) from the preferred AppStore for the user's device and initialize the vape appliance/device. The app may assist the user during the initialization. First, the user places the device on a power dock that comes with the device. If the vape device has never been paired with an electronic device before, the vape device will be ready to now pair with the user's phone. The user turns on their phone and goes to Settings→Bluetooth and confirms that BLUETOOTH is turned on and looking for the new devices in the 'Other Devices' section. The user can then select the vape device and pair the vape device with the phone.

Continuing the above scenario, with the vape device within signal range of the phone and the app open on their phone, the user will be greeted with a welcome prompt for Login credentials, or to 'Create New Account'. Initially, the user will select 'Create New Account' to establish an account. In one aspect of the present invention, New User registration may be limited to four pieces of information, namely, a Login ID, the user's name, the number of months the user has been smoking/vaping, and a Challenge question to determine device programming, such as, 'I want help to quit smoking,' 'I want help to quit vaping,' or 'I just want to vape safely.' The answer to the Challenge question will drive one of multiple programs (in one embodiment, three) on the back end that will help plan the vape device's behavior, as will be discussed in greater detail below.

With the device paired with the user's phone and the app being properly logged into, a vape pod is placed in each of the ports of the vape device. In one aspect of the present invention, the number of ports is three with the vape device having a generally triangular shape such that a vape pod is place in each corner of the vape device. The device can then detect the specific vape pod inserted (i.e., the nicotine concentration of the vape fluid contained therein) and inventory itself. In one aspect of the invention, the corners of the vape device include light emitting diodes (LEDs) that will illuminate, such as either orange, yellow or green, to visually indicate to the user the relative concentrations of the pods, e.g., with green indicating the lowest nicotine concentration, followed by yellow, with orange indicating the highest nicotine concentration. Initially, all of the vape pods are active and the user may choose whichever strength (nicotine concentration) to vape. By way of example, the three vape pods may include the vape industry standard 5% nicotine concentration (orange indicator), a less concentrated 4% nicotine (yellow indicator), or a least concentrated 3% nicotine (green indicator). The system may then record a number of details when the user inhales the vape, which are then used by backend software to compute a customized dosage program that will drive the vape device and the user's overall therapeutic usage, as will be discussed in greater detail below.

As the user progresses through the dosage program, the device will provide up to three different concentrations of nicotine from which to choose, as well as visual indication of the healthiest (lowest nicotine concentration), with green indicating the lowest concentration, yellow indicating an intermediate concentration, and orange indicating the highest concentration. The vape device may initially direct the user to select a lower concentration Pod. Moreover, if a vape pod is indicated in red, then that vape pod is temporarily locked out due to over-use. As will be described in greater detail below, the vape device will not permit the pod coil of the locked-out vape pod to receive power, even if the vape pod is moved to another corner of the vape device. After some time, depending on where user is in the dosage therapy, the locked out vape pod will come back online. A vape pod may also go offline as the user advances through the dosage program and 'graduates' to using a lower dosage (i.e., the user no longer needs the highest concentration vape pod).

The system may also track how often the user makes better choices, such as consuming a lower dosage than the maximum concentration available, or reduced consumption versus the typical frequency and duration of use. The system may also track under what conditions, such as environment or time of day, behavioral improvements or difficulties are occurring. The phone app may also provide positive reinforcement, with techniques such as inspirational stories, notification of better-than-plan usage, Apple health ring performance, and goal setting, etc. This positive reinforcement, combined with temporary lock-outs of overused vape pods, may assist users to resist regression. The phone app may also communicate usage patterns to the back end software for analysis, which may then originate and forward new dosage programming to the vape device as the user progresses within the dosage program. In a further aspect of the present invention, replacement vape pods may be automatically shipped to the user before the vape pod(s) run out of vape fluid.

After some time on the dosage program, new vape pods will arrive at lesser concentration as the back end software determines that the user is ready to advance (i.e., use a less concentrated "highest concentration" vape pod). Ideally, overtime the program will be alternating between a 0 and 1% dilution of nicotine and the dosage program will conclude with the addiction fully addressed.

In a further embodiment of the present invention, the system may further recognize that a user's nicotine cravings may be triggered by conditional patterns, for example, group social gatherings, alcohol consumption, following a meal, and even the time of day. Accordingly, in one embodiment the system and determined dosage program may include recognizing the locations (using Bluetooth Low Energy (BLE) beacon scanning and Global Positioning System (GPS)) and tracking environments where nicotine consumption is elevated. These factors may then be combined with other environmental data logged and consumption data received by the back end software. Still further, it has been recognized that smoking/vaping addiction is both a physiological and psychological condition. Thus, breaking the patterned usage with off-pattern-usage prompting may interfere with the user's conditioning and reduce the addiction and allow a user to have more control. It should also be noted that, while the phone app may not be specifically required for the vape device to operate, daily or weekly use of the phone app may provide the role of a coach or companion. By way of example, the app may actively comment with positive reinforcement, provide tips to support better behavior, chart performance versus targets and illustrate recent usage patterns that may not be as noticeable to the user so that the user may more readily see where performance was better or worse.

In accordance with the above, one aspect of the present invention may be directed to a system for aiding in the cessation of a nicotine dependency. The system comprises a nicotine cessation device having a device housing including a plurality of pod receiving sockets and a plurality of fluid pods. A respective fluid pod is removably coupled with a respective pod receiving socket of the plurality of pod receiving sockets. Each respective fluid pod of the plurality of fluid pods is configured to receive a nicotine fluid having a predetermined concentration of nicotine therein and each respective fluid pod receives a nicotine fluid concentration that is different than at least one other fluid pod. The device housing may further include a printed circuit board (PCB) including a processor and a memory, and a power source.

In one aspect of the invention, each fluid pod comprises a pod housing configured to hold the nicotine fluid therein. Each fluid pod has opposing first and second ends. The first end includes a coil housing communicatively coupled to the PCB and the power source. The second end defines at least one output opening therein. Upon powering of the coil housing via the power source, the nicotine fluid becomes vaporized whereby the vaporized nicotine fluid exits the fluid pod via the at least one output opening.

In a further aspect of the present invention, the second end of the fluid pod is dimensioned to be received between a user's lips during use whereby the vaporized nicotine fluid may be inhaled by the user. The second end of the fluid pod may also include a capacitive sensor configured to be communicatively coupled to the PCB whereby the capacitive sensor communicates a signal to the PCB when the user's lips engage the second end of the fluid pod. The device housing may further include a vacuum sensor coupled to each of the pod receiving sockets whereby the vacuum sensor detects and communicates a draw strength and a draw duration when the vaporized nicotine fluid is being inhaled by the user.

In accordance with yet another aspect of the present invention, each pod receiving socket on the device housing includes a pod receiving interface communicatively coupled to the PCB and the power source. The pod receiving interface engages the first end of the fluid pod when the fluid pod is coupled to the pod receiving socket. The device housing may also include a plurality of indicators. A respective indicator is coupled to a respective pod receiving interface and the first end of each of the fluid pods includes a resistor sensible by the respective pod receiving interface and the PCB. The resistor is indicative of the nicotine fluid concentration within the fluid pod and is selectively modulated to visually communicate the nicotine fluid concentration to the user.

In still another aspect of the present invention, the nicotine cessation device may further comprises a communication module coupled to the PCB and configured for allowing bi-directional data transfer with an external computing device. The communication module and the external computing device are in communication through a network or through synchronization via BLUETOOTH.

It is, therefore, an aspect of the present invention to provide a method of aiding in cessation of nicotine dependency comprising the steps of: a) providing a nicotine cessation device comprising: i) a device housing including a plurality of pod receiving sockets; ii) a plurality of fluid pods, wherein a respective fluid pod is removably coupled with a respective pod receiving socket of the plurality of pod receiving sockets; iii) a printed circuit board (PCB) including a processor and a memory; and iv) a power source, wherein each respective fluid pod of the plurality of fluid pods is configured to receive a nicotine fluid having a predetermined concentration of nicotine therein, and wherein each respective fluid pod receives a nicotine fluid concentration that is different than at least one other fluid pod; b) allowing a user to inhale a vaporized portion of a selected nicotine fluid from a selected fluid pod of the plurality of fluid pods; c) detecting the selected fluid pod and the predetermined concentration of the selected nicotine fluid; d) measuring one or more of: i) a duration of the inhale; ii) a draw force of the inhale; iii) a length of time between successive inhales and e) calculating a nicotine intake for the inhale.

In another aspect of the present invention, a further step comprises providing the nicotine cessation device with a communication module coupled to the PCB and configured for allowing bi-directional data transfer with an external computing device. The external computing device includes a second memory and a software application stored in the second memory. The software application is configured to access a remote server. The communication module and the external computing device are in communication through a network or through synchronization via BLUETOOTH.

Additional aspects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein:

FIG. 8 is a side perspective view (top) and exploded view (middle and bottom) of the fluid pod shown in FIG. 6;

DETAILED DESCRIPTION OF THE INVENTION

Figure 1:
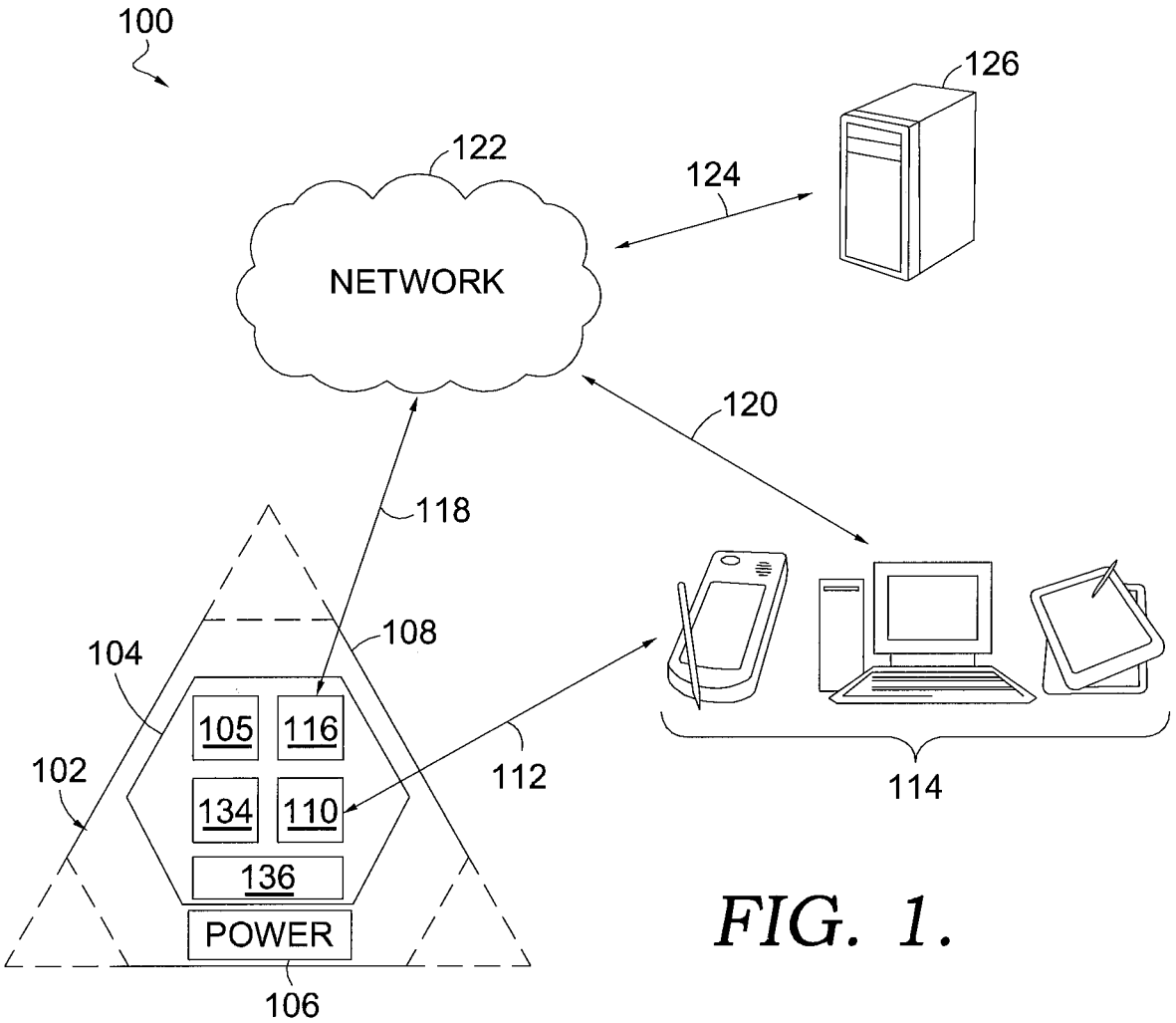
FIG. 1 is a schematic view of a nicotine cessation system in accordance with an aspect of the present invention.
Figure 2:
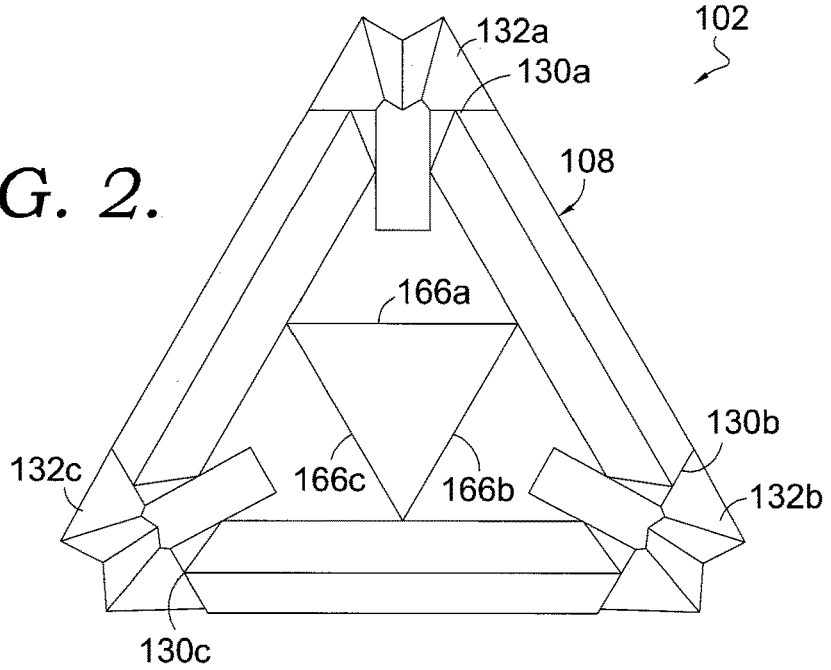
FIG. 2 is a top plan view of a nicotine cessation device configured for use within the nicotine cessation system shown in FIG. 1.

Referring to the drawings in detail, and specifically to FIG. 1, a nicotine cessation system according to one aspect of the present invention is generally designated as reference numeral 100. System 100 comprises a nicotine cessation device 102 including a printed circuit board (PCB) 104 which may be integrated as a system-on-a-chip (SoC) and power source 106 disposed within a housing 108. PCB 104 may include a radio module 105, as well as a BLUETOOTH module 110 for wireless communication 112 between nicotine cessation device 102 and an external computing device 114, such as, for example, a smart phone, desktop personal computer (PC), laptop computer, tablet PC, and the like. PCB 104 may also include a Wi-Fi module 116 which also enables wireless communication 118, 120 between nicotine cessation device 102 and external computing device 114, such as via the Internet or cellular network 122. Network 122 may also provide communication 118, 124 between nicotine cessation device 102 and server 126. Modules 110, 116 are not limited to any specific hardware or software configuration, but may rather be implemented as computer executable instructions in any computing or processing environment, including in digital electronic circuitry or in computer hardware, firmware, device driver, or software.

Additionally, external computing device 114, when embodied by a wireless handheld device, such as a smart phone, tablet PC or the like, may include a software application ("app") stored in a memory of external computing device 114. The app is programmed and configured to program, configure, edit or otherwise customize nicotine cessation system files that are stored in external computing device 114, which will be discussed in greater detail below. The app may be preloaded in the memory of external computing device 114, or may be downloaded from server 126 via network 122. The app may be configured to allow external computing device 114 to download nicotine cessation system files stored on server 126 to the memory of external computing device 114. These downloaded files may then be programmed, configured, edited or otherwise customized as described herein. Using the app, a user may disseminate one or more nicotine cessation system files to one or more multiple external computing devices 114. This may be of particular advantage when access to server 126 requires a subscription or other associated service fee. In yet another example, nicotine cessation system files may be preloaded in the memory of external computing device 114 so that the user does not need to perform any downloading using external computing device 114 or server 126.

By way of example, BLUETOOTH module 110 may include both a BLUETOOTH Link Controller and BLUETOOTH Baseband Controller supporting v4.2 BR/EDR and BLUETOOTH Low Energy (BLE). BLE may then be the method of communication used between nicotine cessation device 102 and the frontend software (app) resident on the user's external computing device 114 (e.g., smartphone). Data sent to and from nicotine cessation device 102 and the frontend application is encoded using the BLE communication profile defined in the Generic Attribute Profile (GATT) called HDP (Health Device Profile). This profile supports Secure Simple Pairing (SSP) between devices and is the method used for pairing nicotine cessation device 102 to external computing device 114. As is part of the HDP, nicotine cessation device 102 communicates on the Multi-Channel Adaptation Protocol (MCAP layer) within BLE. This enables nicotine cessation device 102 to communicate usage records and inventory identification to the frontend application, while the frontend software writes back a set of Usage Map (which instructs how to permit dispensing) within what GATT defines as a characteristic.

Communication between nicotine cessation device 102 and the frontend application incorporates an industry standard for personal health device communications by the IEEE. This provides a unique integration for interoperability with standards based medical monitoring devices that could exist in medical offices and hospitals while limiting the access to secure and proprietary instructions for dosage that is maintained by the frontend application. By way of example, the standard utilized for this communication may be—Medication monitor—0x1048 (4168 decimal)—Defined within IEEE standard: 11073-10472 Health informatics—Personal health device communication—Device specialization—Medication monitor.

Turning now to FIGS. 2-5, nicotine cessation device 102 generally comprises device housing 108 which includes a plurality of pod receiving sockets 130*a*, 130*b*, 130*c* (generally pod receiving socket 130) and a plurality of fluid pods 132*a*, 1232*b*, 132*c* (generally fluid pod 132). Each respective fluid pod 132 is configured to be removably coupled with a respective pod receiving socket 130. In accordance with an aspect of the present invention, each respective fluid pod 132 is configured to receive a nicotine fluid having a predetermined concentration of nicotine therein. In a further aspect each respective fluid pod 132 receives a nicotine fluid concentration that is different than at least one other fluid pod 132. By way of example, fluid pod 132*a* may contain a first vape fluid having a 5% nicotine concentration, while fluid pod 132*b* may contain a second vape fluid having a 4% nicotine concentration and fluid pod 132*c* may contain a third vape fluid having a 3% nicotine concentration, the purpose of which will be discussed in greater detail below. Device housing 108 further includes power source 106 and PCB 104 which includes a processor 134 and a memory 136, all of which will be discussed in greater detail below.

Figure 6:
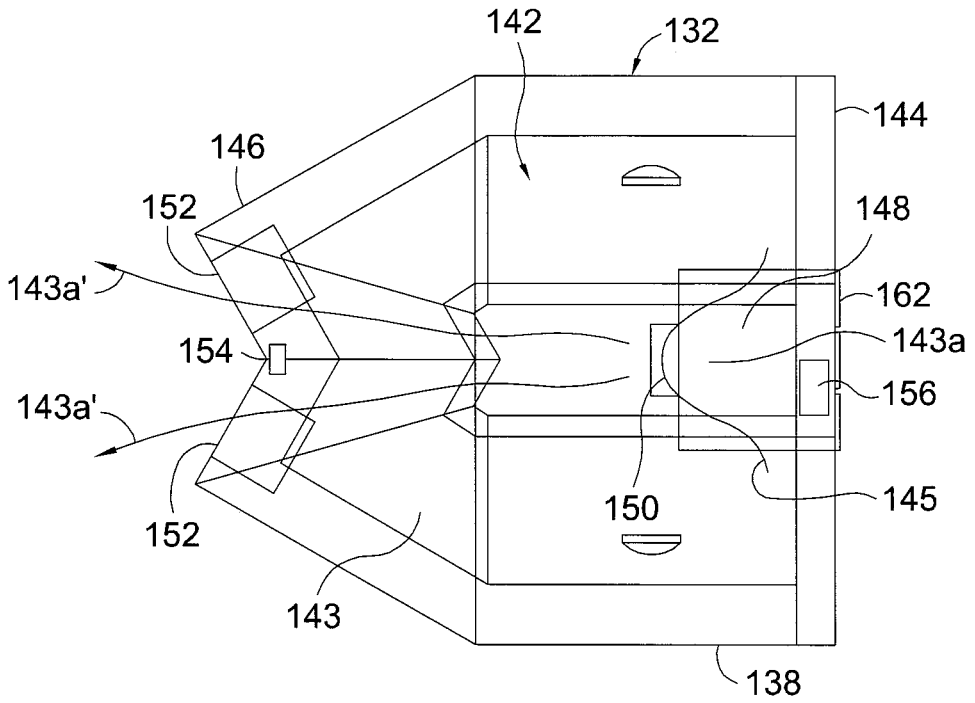
FIG. 6 is a top phantom view of a fluid pod configured for use within the nicotine cessation device housing of the nicotine cessation device shown in FIG. 2.
Figure 7:
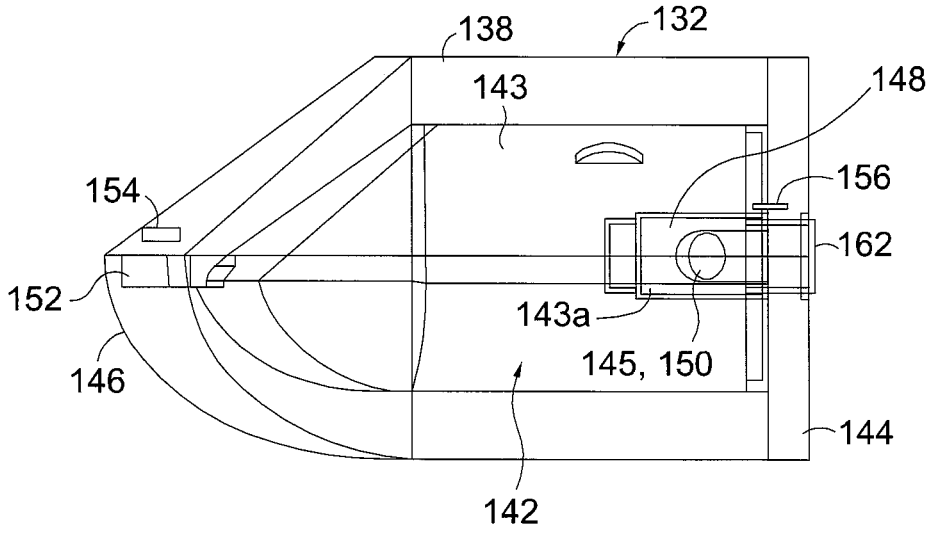
FIG. 7 is a side phantom view of the fluid pod shown in FIG. 6.

With reference to FIGS. 6-8, each fluid pod 132 may generally comprise three elements: a vaporizing coil, vape juice/fluid, and an identification circuit as will be discussed below. To that end, fluid pod 132 includes a pod housing 138 defining a cavity 142 configured to hold the vape juice/fluid 143 therein. Each pod housing 138 has opposing first and second ends 144, 146. First end 144 includes a coil housing 148 communicatively coupled to PCB 104 and power source 106. Upon providing power to coil housing 148 via power source 106, the vape juice/fluid 143*a* is carried by wick 145 into coil housing 148 where it is heated by vaporizing coil 150 until the fluid vaporizes. In accordance with an exemplary embodiment of the present invention, vaporizing coil 150 may utilize a 36 gauge nichrome 80 wire. Nichrome 80 wire is an alloy of nickel and chromium and has a melting point of about 1,400° C. The resistance of this coil is calculated to be 2.4 Ohms (D×26.510 Ohms per foot). As a result, approximately 6.67 watts of power may be required at 4v to initiate atomization of vape juice/fluid 143*a*.

To promote inhalation of the vaporized vape juice/fluid 143*a*', second end 146 of pod housing 138 may define at least one output opening 152 therein whereby the vaporized vape juice/fluid 143*a*' may exit fluid pod 132. In one aspect of the invention, second end 146 of pod housing 138 is dimensioned to be received between a user's lips during use whereby the vaporized vape juice/fluid 143*a*' may be inhaled by the user. In a further aspect, second end 146 may also include a capacitive sensor 154 communicatively coupled to PCB 104. Capacitive sensor 154 may then communicate a signal to PCB 104 when said user's lips engage second end 146 of fluid pod 132 so that each specific fluid pod 132*a*, 132*b*, 132*c* may be individually monitored and measured, as will be described in greater detail below.

To further distinguish fluid pods 132*a*, 132*b*, 132*c*, each fluid pod 132 may include a resistor 156 located on coil housing 148. Resistor 156 may then provide a signal to PCB 104 identifying the concentration of the vape juice/fluid 143 contained in its respective fluid pod 132. By way of example and without limitation thereto, when fluid pod 132 is inserted into device housing 108, one or more contacts, such as a pogo pin 158, within pod receiving interface 160 within pod receiving socket 130 (see FIG. 3A) may engage with a respective corresponding contact 162 on fluid pod 132 to complete the circuit. An exemplary paradigm is shown below in Table 1.

TABLE 1

| Resistor 156 | Nicotine Concentration |
|---|---|
| 2k Ohms | 5% |
| 4k Ohms | 4% |
| 6k Ohms | 3% |

TABLE 1-continued

| Resistor 156 | Nicotine Concentration |
|---|---|
| 8k Ohms | 2% |
| 10k Ohms | 1% |
| 12k Ohms | 0% |

Figure 3:
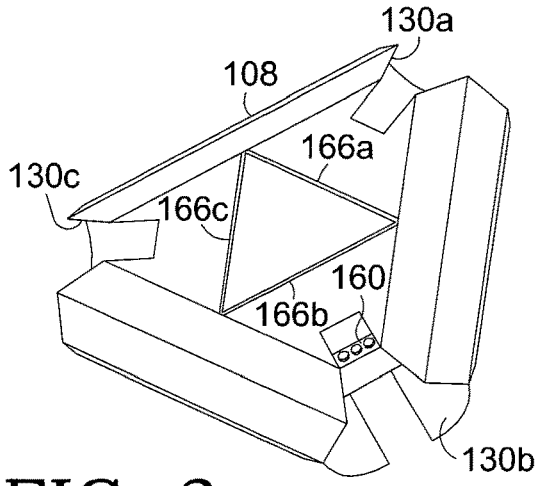
FIG. 3 is a perspective view of a nicotine cessation device housing of the nicotine cessation device shown in FIG. 2.
Figure 3A:
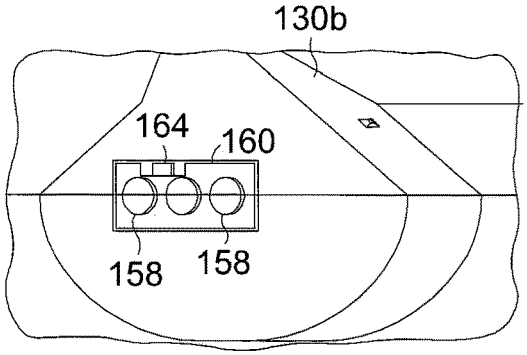
FIG. 3A is an expanded view of a pod receiving socket of the nicotine cessation device housing shown in FIG. 3.
Figure 4:
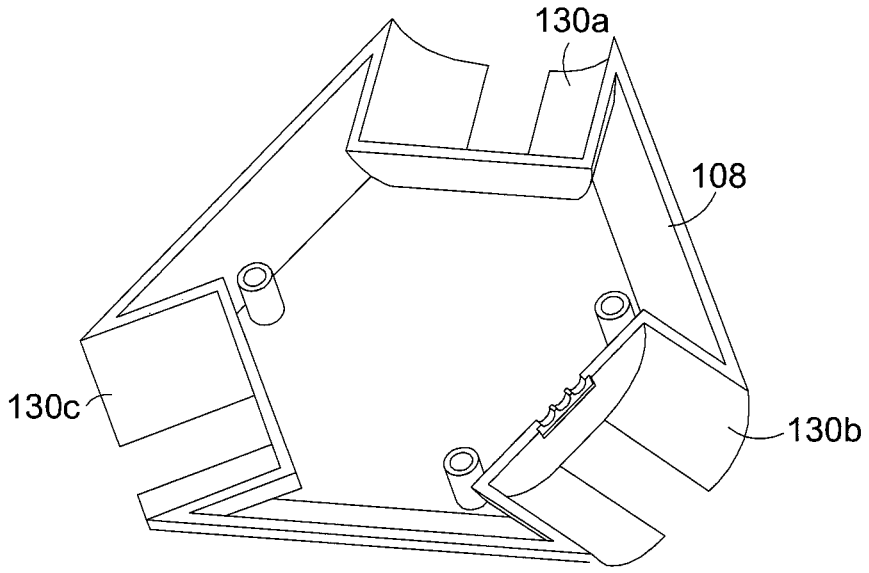
FIG. 4 is a cross section view of the nicotine cessation device housing shown in FIG. 2.
Figure 5:
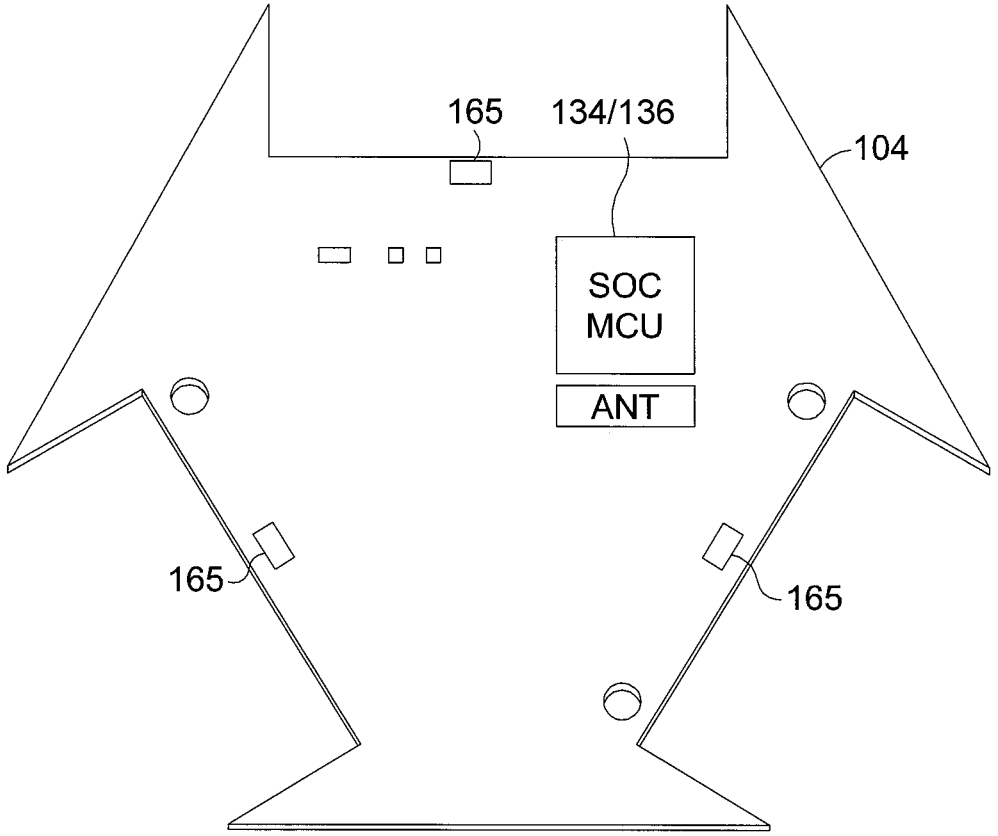
FIG. 5 is a top plan view of an exemplary printed circuit board used within the nicotine cessation device shown in FIG. 2.

With additional reference to FIG. 3A, device housing 108 may further include a respective diaphragm 164 coupled to each of the pod receiving sockets 130*a*, 130*b*, 130*c* and being selectively flexible when subject to a vacuum force, such as a draw force upon second end 146 of fluid pod 132 during a vaping inhalation. Each diaphragm 164 is operably coupled to a respective vacuum sensor 165 mounted within housing 108. In this manner, each diaphragm 164/sensor 165 pair may then individually detect and communicate a draw strength and a draw duration when the vaporized nicotine fluid 143*a*' is being drawn through output opening 152 of the selected fluid pod 132 and inhaled by the user, as described above.

As discussed above, device housing 108 may further include a plurality of indicators 166*a*, 166*b*, 166*c* (collectively, "indicator 166"), such as but not limited to multicolor light emitting diodes (LEDs). A respective indicator 166 may be coupled to a respective pod receiving socket 130 or pod receiving interface 160. Each respective indicator 166 may be selectively modulated to visually communicate the nicotine concentration of the vape juice/fluid 143 within the respective fluid pod 132*a*, 132*b*, 132*c*. For instance, as described above, each fluid pod 132 may include a resistor 156 sensible by its respective pod receiving interface 160 and PCB 104. In this manner, indicators 166*a*, 166*b*, 166*c* may illuminate, such as either orange, yellow or green, to visually indicate to the user the relative nicotine concentrations of the vape juice/liquid 143 within their respective fluid pod 132*a*, 132*b*, 132*c*. In one aspect of the present invention, a green indicator (e.g., indicator 166*a*) may indicate the lowest nicotine concentration, followed by yellow (e.g., indicator 166*b*), with orange (e.g., indicator 166*c*) indicating the highest nicotine concentration.

Initially, all of the vape pods are active and the user may choose whichever strength (nicotine concentration) to vape. By way of example, the three vape pods may include the vape industry standard 5% nicotine concentration (orange indicator), a less concentrated 4% nicotine (yellow indicator), or a least concentrated 3% nicotine (green indicator). In a further aspect of the present invention, if an indicator 166 is colored red, the corresponding fluid pod 132 may be temporarily locked out (unable to produce vaporized vape juice/fluid 143*a*) due to over-use. After some time, depending on where the user is in the dosage therapy, the locked out fluid pod may come back online.

Figure 9:
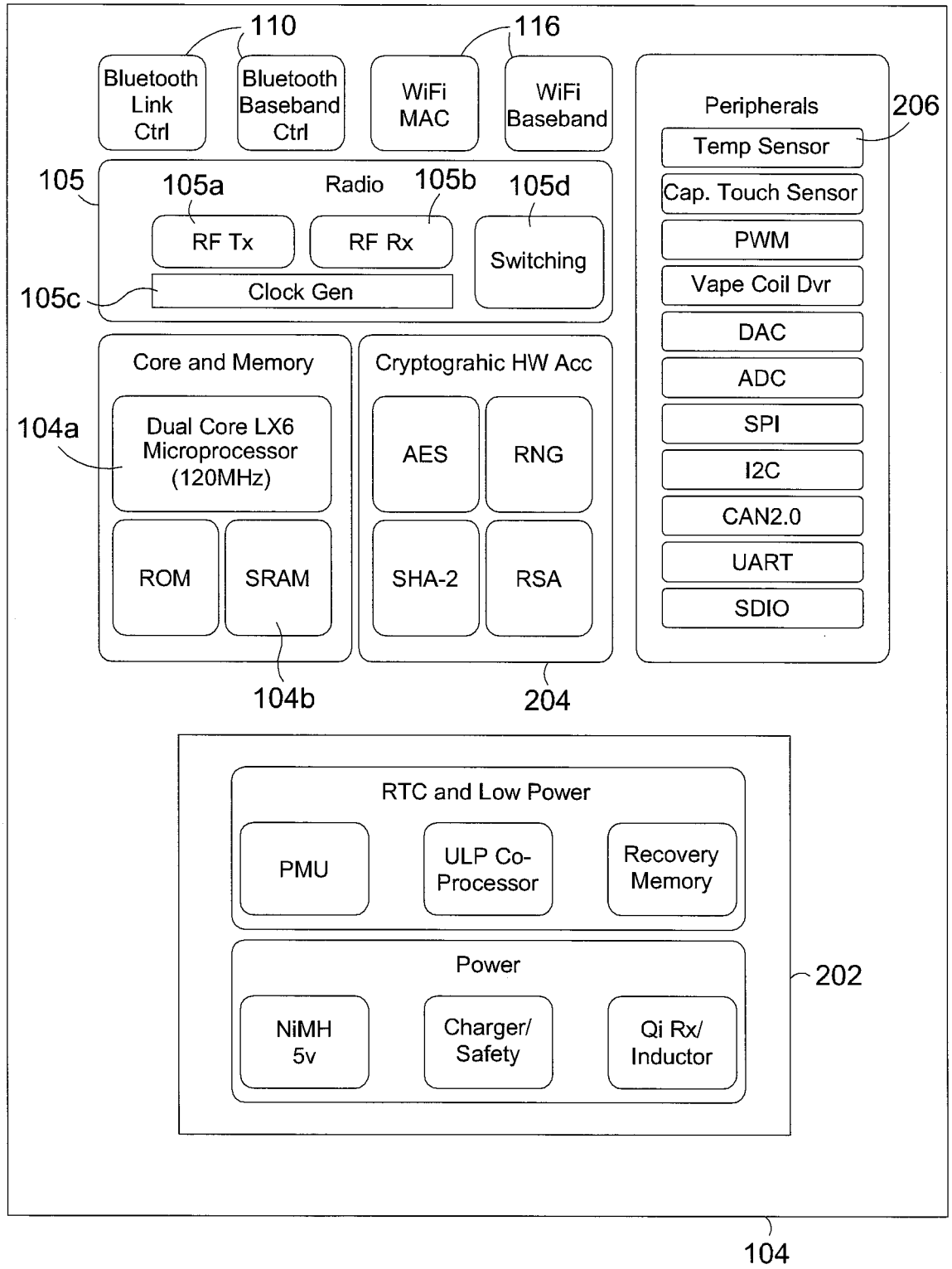
FIG. 9 is a schematic view of system-on-a-chip used within the nicotine cessation device shown in FIG. 2.
Figure 10:
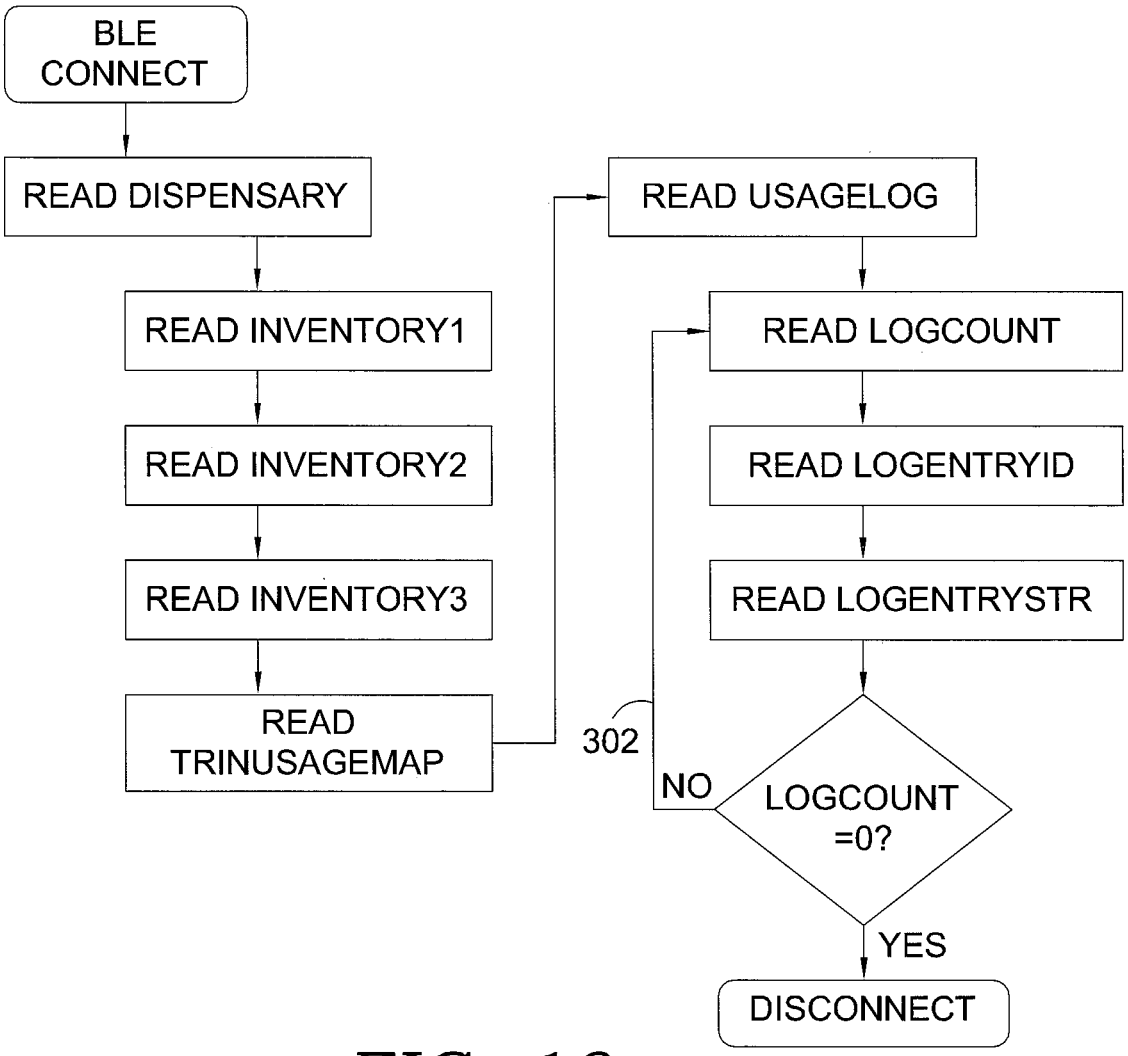
FIG. 10 is a flow diagram of an exemplary process of synchronizing a nicotine cessation device to a frontend application in accordance with an aspect of the present invention.

With reference to FIG. 9, nicotine cessation device 102 may further include a number of peripheral devices and associated modules operably coupled to PCB 104 and power source 106, as appropriate. By way of further example, peripheral devices and modules may include real time clock and lower power module 202. In one aspect of the present invention, nicotine cessation device 102 is generally maintained in a low-power sleep mode. The real-time clock (RTC) periodically wakes nicotine cessation device 102 to listen for an initiator. A brief secure connection is established with the BLE Standard. External computing device 114 is considered the BLUETOOTH Sink and the Initiator setting up the periodic control channel. The process of syncing to the frontend app is illustrated in FIG. 10 and has one main event loop 302 that repeats until synchronization is completed.

Radio module 105 includes a radio frequency (RF) transmitter (Tx) 105*a* and RF Receiver (Rx) 105*b*, a Clock Generator 105*c* and a packet Switch 105*d*. In one aspect of the invention, PCB/SoC 104 uses two LX6 cores 104*a* each running up to 120 MHz while an internal SRAM 104*b* is divided into 2 parts, fast and slow. The fast SRAM can be accessed by the CPU and when coming out of RTC boot (deep sleep), and the Slow SRAM can be accessed by the co-processor of lower power module 202 during the deep sleep mode. 4Mbytes (32 Mbits) of Flash may be built in to maintain log storage between periodic BLUETOOTH syncing with the frontend app. Nicotine cessation device 102 may also include an encryption module 204 that incorporates hardware-based acceleration for encryption including AES, RNG, SHA2, RSA which optionally can be used for both storage of data and data transfer to a paired device or medical hub. Additionally, a built-in temperature sensor 206 may provide accurate logging and monitoring of the nicotine cessation device 102 while in use and during wake periods between low power mode sleep intervals. If a temperature of greater than 115 F is measured, the program will shut down to safety mode for 2 minutes before resampling the temperature. During this period, nicotine cessation device 102 will not permit vape usage. During normal operation, ambient temperature is captured by temperature sensor 206.

In a further aspect of the present invention, the nicotine cessation device 102 power systems may be completely contained within nicotine cessation device 102 such that there are no external connections for charging of the power source (rechargeable battery) 106. In accordance with this aspect, battery 106 is not serviceable and should last for multiple days between charges given regular use. More specifically, power source 106 may comprise a Lithium Ion Polymer (LiPo) 3.7v 420 mAh battery which is installed during manufacturing. A Qi Rx circuit is integrated in nicotine cessation device 102 and coupled with an inductor coil at the center of the nicotine cessation device 102. The inductor coil handshakes with the charging dock (compatible with any Qi charger) to enable the transmitting inductor coil to begin providing a 5v inductive charge. The inductor coil powers the recharging circuit within nicotine cessation device 102 at a regulated 3.7v. Thus, the charging dock contains a wireless transmitting coil that may communicate with the receiving coil of nicotine cessation device 102 to charge a lithium battery following standard Qi induction protocol. The charging dock may be equipped with standard micro USB receptacle for connection to 5v+, Gnd over USB. The charging circuit is driven by the power fed from the Qi circuit. The charging circuit balances power output to both nicotine cessation device 102 and the internal LiPo battery. In one aspect, charging time may be about 60 minutes with a 2A power source.

As described above, during use when a user inhales from an active fluid pod 132, the vaporizing coil 150 is energized and vape juice/fluid 143*a* is atomized allowing for inhalation. During this mode, a number of details are recorded by nicotine cessation device 102 and later combined during synchronization with the phone app logs. These details are then communicated back to the backend server 126 to generate a dosage program or incorporate the usage data with an already-existing dosage program. The results of this analysis produce a new or improved dosage program which is updated to the phone app over network 122.

In total, the backend server 126 aggregates and analyzes the following captured data from the nicotine cessation device (NCD) 102 and frontend app to compute changes to the Dosage Program:

NCD 102: Start time of Vape;

NCD 102: Duration of Vape;

NCD 102: Strength of vacuum (how forceful was the draw);

NCD 102: Number of BLUETOOTH beacons in the immediate area, and within range;

NCD 102: Location (GPS);

NCD 102: temp/humidity;

NCD 102: Sync Time;

NCD 102: Noise level;

NCD 102: Elevation;

NCD 102: Pod nicotine concentration (PNC),

CALC: Overall consumption of dose;

CALC: Actual use vs target use.

Figure 11:
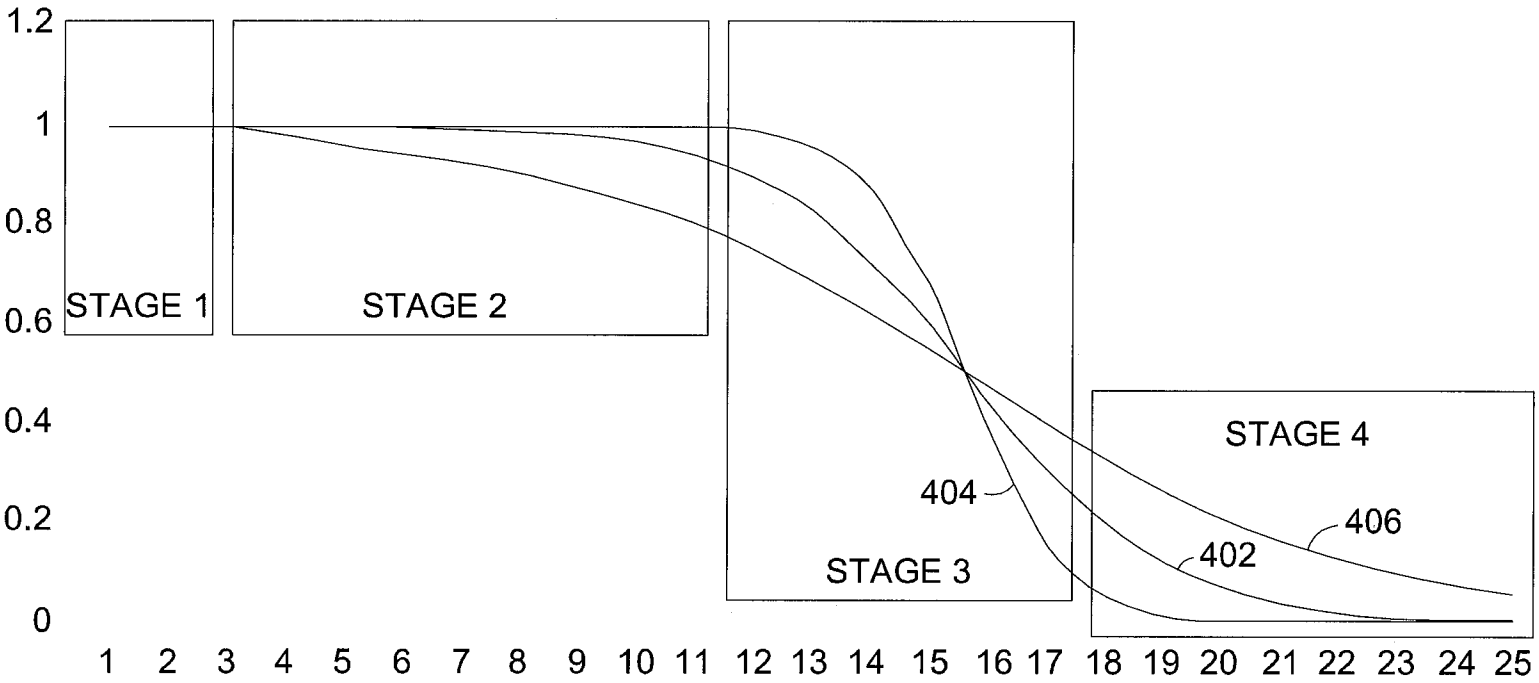
FIG. 11 is a graphical representation of three different exemplary dosage programs for use within the nicotine cessation system shown in FIG. 1.

In a further aspect of the present invention and with reference to FIG. 11, the dosage program may apply medically accepted strategies into stages and translates that into algorithms for reducing nicotine addiction. There are three objectives for users as described above. Users may be looking to complete one of three program modes: 1) I want help to stop smoking; 2) I want help to stop vaping; or 3) I just want to vape more safely. In all three modes of operation above, the dosage program has 4 stages. Each stage represents a period of time that the program behaves with a different objective for the user. Depending on the user's ability to meet the programmed behavior, the stages will advance, or shift to another algorithm that could be more or less aggressive. The four stages are:

Stage 1) Initialization Baseline Consumption—nicotine cessation device 102 monitors usage and logs activity with little to no lock out. This phase is to determine the magnitude of the addiction. Heavy consumption will generally lead to Program 1, as shown as curve 402 in FIG. 11, where the target consumption will be very gradual with no sudden drops. Light to moderate consumption will generally lead to Program 2, as shown as curve 404 in FIG. 11, where the target consumption may be reduced more quickly than Program 1. Program 3 (curve 406) may be used with those trying to reduce nicotine consumption without complete lamination, where nicotine concentration is gradually decreased until reaching the lowest nicotine concentration that the user is comfortable consuming;

Stage 2) Decrease and calibration—nicotine cessation device 102 will begin to adjust the dosage, and track how well the user is able to adjust their consumption. This phase will be a lightly gradual decrease in most cases;

Stage 3) Progression—This stage is where most of the behavioral change is performed and where most progress is expected. The rate of change will still allow for typical swings in progress that comes from addiction, but will be a more rigid stage that the previous two stages; and Stage 4) Landing—If the Program was successful for users that are looking to completely lose the addiction, than this could be a very short stage of the program. For the users that are simply looking to vape safely, this will be a looping between monitoring and reduction, with the ultimate goal of maintaining a daily intake of 3 mg or lower nicotine use. For all other users, the nicotine cessation device 102 will now operate with pods having 0% nicotine concentration.

Figure 12:
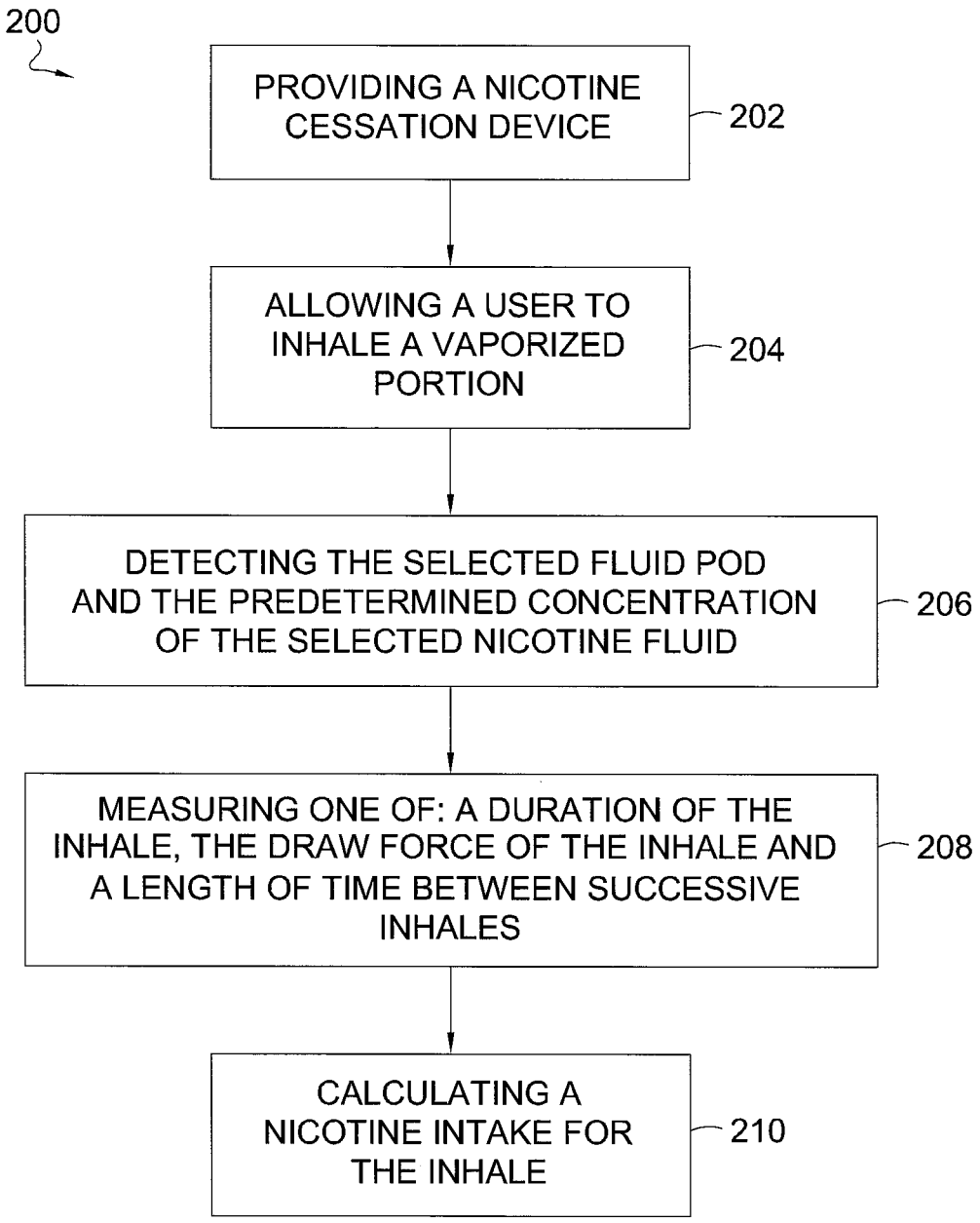
FIG. 12 is a flow diagram of an exemplary method of using the nicotine cessation system shown in FIG. 1.

FIG. 12 is a flow diagram showing an exemplary method 200 that may be implemented using system 100 in accordance with one aspect of the present invention. In particular, as previously mentioned, method 200 is computer-implemented and programmed for execution in a computing environment for aiding in cessation of nicotine dependency. Method 200 generally comprises the steps of 202) providing a nicotine cessation device comprising: i) a device housing including a plurality of pod receiving sockets; ii) a plurality of fluid pods, wherein a respective fluid pod is removably coupled with a respective pod receiving socket of said plurality of pod receiving sockets; iii) a printed circuit board (PCB) including a processor and a memory; and iv) a power source, wherein each respective fluid pod of said plurality of fluid pods is configured to receive a nicotine fluid having a predetermined concentration of nicotine therein, and wherein each respective fluid pod receives a nicotine fluid concentration that is different than at least one other fluid pod; 204) allowing a user to inhale a vaporized portion of a selected nicotine fluid from a selected fluid pod of said plurality of fluid pods; 206) detecting the selected fluid pod and the predetermined concentration of the selected nicotine fluid; 208) measuring one or more of: i) a duration of the inhale; ii) a draw force of the inhale; iii) a length of time between successive inhales; and 210) calculating a nicotine intake for the inhale.

Figures 13A, 13B, 13C:
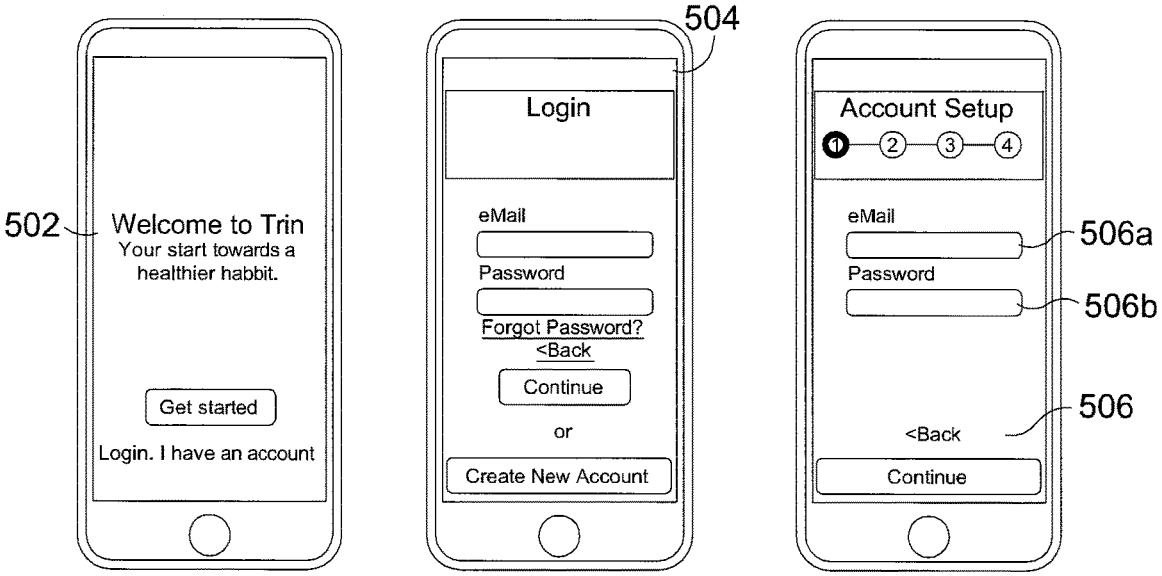
FIGS. 13A-13F are exemplary screenshots of the frontend application showing Login/Account Setup for the nicotine cessation system shown in FIG. 1.
Figures 13D, 13E, 13F:
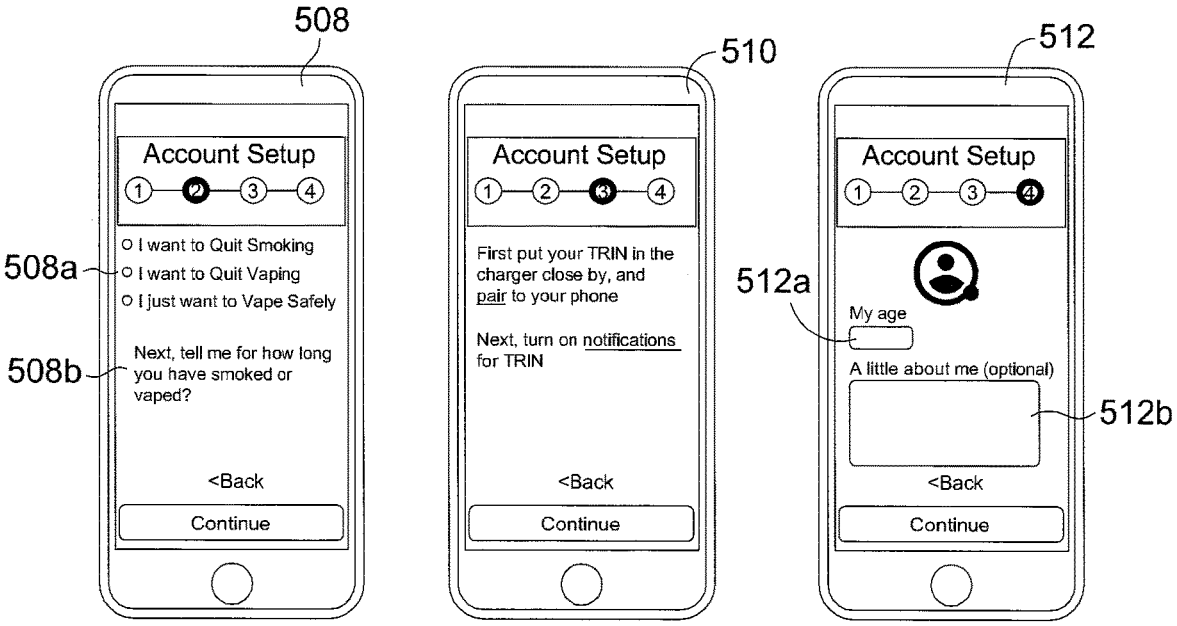

As described above, a user must first initialize the nicotine cessation device 102 prior to its first use. As shown in FIGS. 13A-13F, in a further aspect of the present invention, the frontend application may assist user initiation. It should be noted that FIGS. 13-13F show representative screenshots of the frontend application as displayed on an Apple iPhone smartphone, but it should be further noted that the frontend application may be configured for use with any suitable computer operating system including, but not limited to, iOS and Android. After downloading and installing the frontend application, the user needs to complete two tasks, namely pairing the nicotine cessation device 102 with the external computing device (e.g., iPhone) 114 and creating a user account. After viewing the home screen 502 (FIG. 13A), the user will then be asked to Login through a Login screen 504 (FIG. 13B). Before first use, the user sets up an account in an Account Setup screen 506 by inputting an email address 506*a* and selecting a password 506*b* (FIG. 13C). The frontend application will then present a second Account Setup screen 508, such as that shown in FIG. 13D, presenting a Challenge question 508*a* and asking for the length of time the user has smoked and/or vaped 508*b*. If the nicotine cessation device 102 has not already been paired with the external computing device 114, the frontend application will instruct the user to do so using Account Setup screen 510. See FIG. 13E. The final Account Setup screen 512 asks for the user's age 512*a* and any additional, optional information 512*b* the user would like to provide. Once logged in and registered, the user can begin to use the nicotine cessation device 102 as described above to generate and progress along a personalized dosage therapy program.

Figure 14:
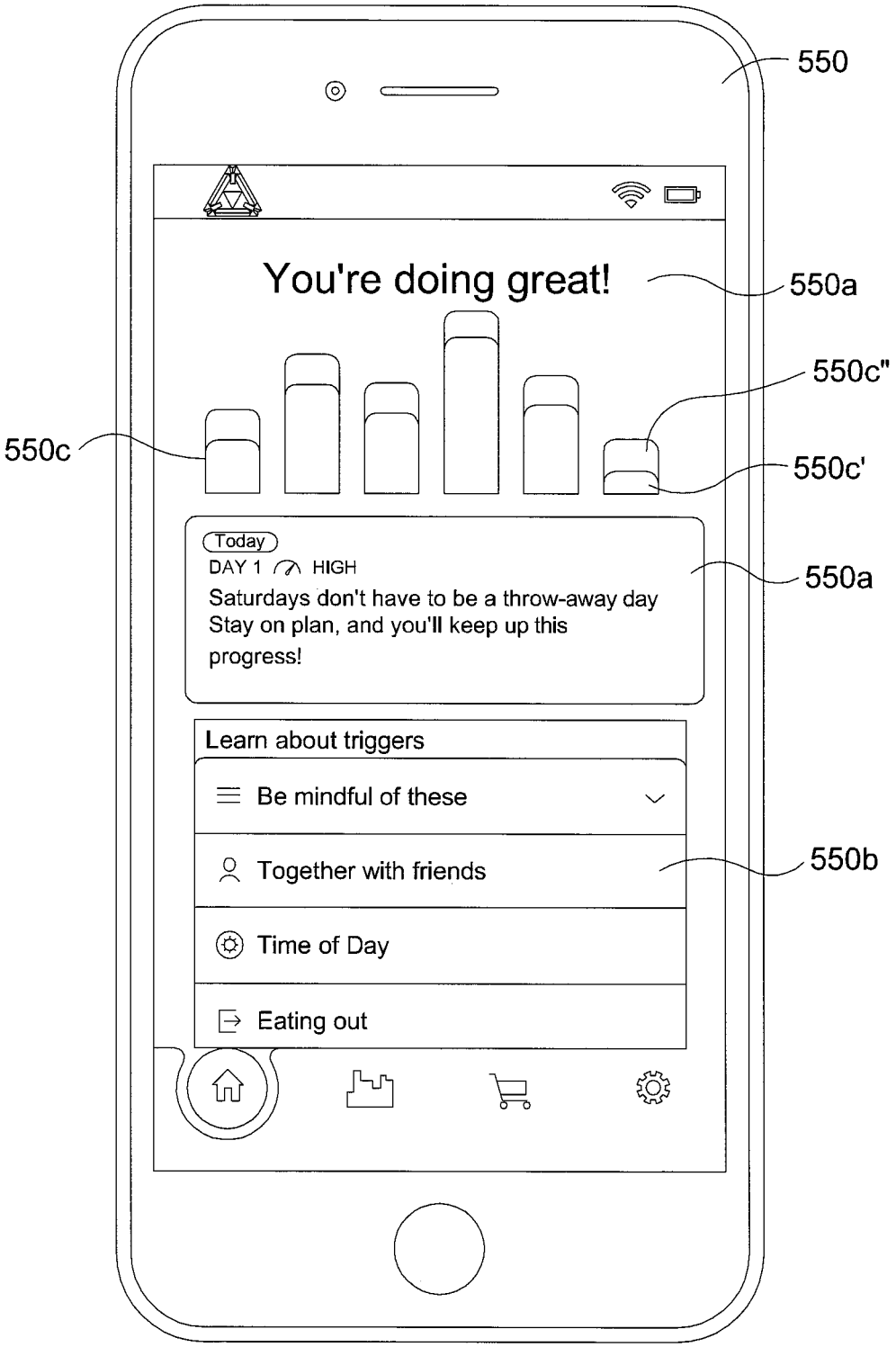
FIG. 14 is an exemplary screenshot of the frontend application during a dosage therapy program.

Turning now to FIG. 14, an exemplary screenshot 550 of the frontend application at some point in time during a user's personalized dosage therapy program. As shown in screenshot 550, the application may actively comment with positive reinforcement 550*a*, provide tips to support better behavior 550*b*, chart performance 550*c* showing actual use 550*c*' versus targets 550*c*" and illustrate recent usage patterns that may not be as noticeable to the user so that the user may more readily see where performance was better or worse.

Figure 15:
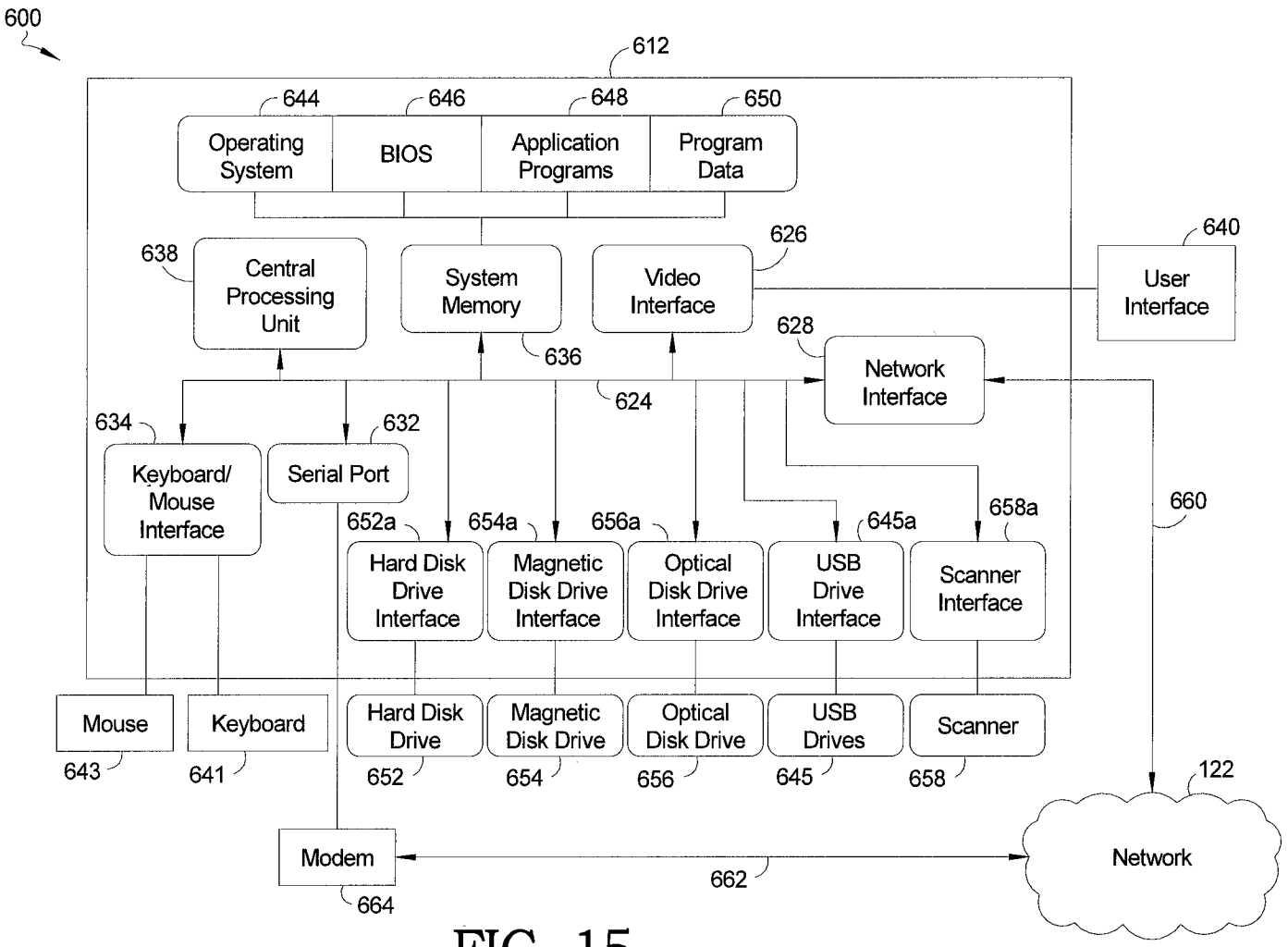
FIG. 15 is a block diagram generally illustrating a computing environment in which the invention may be implemented.

FIG. 15 shows an exemplary computing environment 600 that can be used to implement any of the processing thus far described. Computing environment 600 may include one or more computers 612 (such as nicotine cessation device 102, remote computing device 114, server 126) comprising a system bus 624 that couples a video interface 626, network interface 628, a keyboard/mouse interface 634, and a system memory 636 to a Central Processing Unit (CPU) 638. A monitor or display 640 is connected to bus 624 by video interface 626 and provides the user with a graphical user interface to view, edit, and prepare a print order using digital images, including the selection of an identified substrate, or the selection a size and/or display location for a print product. The graphical user interface allows the user to enter commands and information into computer 612 using a keyboard 641 and a user interface selection device 643, such as a mouse, touch screen, or other pointing device. Keyboard 641 and user interface selection device are connected to bus 624 through keyboard/mouse interface 634. The display 640 and user interface selection device 643 are used in combination to form the graphical user interface which allows the user to implement at least a portion of the present invention. Other peripheral devices may be connected to the remote computer through universal serial bus (USB) drives 645 to transfer information to and from computer 612. For example, cameras and camcorders may be connected to computer 612 through serial port 632 or USB drives 645 so that data representative of a digital image or video may be downloaded to system memory 636 or another memory storage device associated with computer 612.

The system memory 636 is also connected to bus 624 and may include read only memory (ROM), random access memory (RAM), an operating system 644, a basic input/output system (BIOS) 646, application programs 648 and program data 650. The computer 612 may further include a hard disk drive 652 for reading from and writing to a hard disk, a magnetic disk drive 654 for reading from and writing to a removable magnetic disk (e.g., floppy disk), and an optical disk drive 656 for reading from and writing to a removable optical disk (e.g., CD ROM or other optical media). The computer 612 may also include USB drives 645 and other types of drives for reading from and writing to flash memory devices (e.g., compact flash, memory stick/PRO and DUO, SD card, multimedia card, smart media xD card), and a scanner 658 for scanning items such as digital images to be downloaded to computer 612. A hard disk drive interface 652*a*, magnetic disk drive interface 654*a*, an optical drive interface 656*a*, a USB drive interface 645*a*, and a scanner interface 658*a* operate to connect bus 624 to hard disk drive 652, magnetic disk drive 654, optical disk drive 656, USB drive 645 and scanner 658, respectively. Each of these drive components and their associated computer-readable media may provide computer 612 with non-volatile storage of computer-readable instruction, program modules, data structures, application programs, an operating system, and other data for computer 612. In addition, it will be understood that computer 612 may also utilize other types of computer-readable media in addition to those types set forth herein, such as digital video disks, random access memory, read only memory, other types of flash memory cards, magnetic cassettes, and the like.

Computer 612 may operate in a networked environment using logical connections with each of the system components described above. Network interface 628 provides a communication path 660 between bus 624 and network 122. This type of logical network connection is commonly used in conjunction with a local area network (LAN). Files may also be communicated from bus 624 through a communication path 662 to network 122 using serial port 632 and a modem 664. Using a modem connection between the computer 612 and the other components of system 100 is commonly used in conjunction with a wide area network (WAN). It will be appreciated that the network connections shown herein are merely exemplary, and it is within the scope of the present invention to use other types of network connections between computer 612 and the other components of system 100 including both wired and wireless connections.

From the foregoing, it will be seen that this invention is one well adapted to attain all the ends and objects hereinabove set forth together with other advantages which are obvious and which are inherent to the method and apparatus. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. As used herein, the terms "having" and/or "including" and other terms of inclusion are terms indicative of inclusion rather than requirement.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. A system for aiding in the cessation of a nicotine dependency, the system comprising:

a) a nicotine cessation device comprising:

i) a device housing including a plurality of pod receiving sockets, wherein each of said pod receiving sockets is spaced apart from one another; and ii) a plurality of fluid pods, wherein each of said fluid pods has a first end and a second end, wherein said first end is removably coupled with a respective pod receiving socket of said plurality of pod receiving sockets, and wherein said second end is configured to be received between lips of a user of said nicotine cessation device, wherein each respective fluid pod of said plurality of fluid pods is configured to receive a nicotine fluid having a predetermined concentration of nicotine therein, wherein each respective fluid pod receives a nicotine fluid concentration that is different than at least one other fluid pod, and wherein only said second end of one of said fluid pods of said plurality of fluid pods is available at a time to dispense vaporized nicotine fluid to said user.

2. The system of claim 1 wherein the device housing further includes a printed circuit board (PCB) including a processor and a memory, and a power source.

3. The system of claim 2 wherein each fluid pod comprises a pod housing configured to hold said nicotine fluid therein, wherein each respective said first end includes a coil housing communicatively coupled to said PCB and said power source, wherein each respective said second end defines at least one output opening therein, whereupon powering of a vaporizing coil within said coil housing of said selected one fluid pod via said power source vaporizes said nicotine fluid whereby said vaporized nicotine fluid exits said fluid pod via said at least one output opening of said second end of said selected one fluid pod.

4. The system of claim 3 wherein said second end of said fluid pod includes a capacitive sensor configured to be communicatively coupled to said PCB whereby said capacitive sensor communicates a signal to said PCB when said lips of said user engage said second end of said fluid pod.

5. The system of claim 3 wherein said device housing further includes a sensor coupled to each of said pod receiving sockets whereby said sensor detects and communicates a draw strength and a draw duration when said vaporized nicotine fluid is being inhaled by said user.

6. The system of claim 3 wherein each said pod receiving socket on said device housing includes a pod receiving interface communicatively coupled to said PCB and said power source, wherein said pod receiving interface engages a corresponding contact on said first end of said fluid pod when said fluid pod is coupled to said pod receiving socket.

7. The system of claim 6 wherein said device housing includes a plurality of indicators, wherein each of said indicators is coupled to a respective pod receiving interface, and wherein said first end of each of said fluid pods includes a resistor sensible by said respective pod receiving interface and said PCB, wherein said resistor is indicative of said predetermined nicotine fluid concentration within said fluid pod, and whereby said respective indicator is selectively modulated to visually communicate said predetermined nicotine fluid concentration.

8. The system in accordance with claim 2, wherein said nicotine cessation device further comprises a communication module coupled to said PCB and configured for allowing bi-directional data transfer with an external computing device.

9. The system in accordance with claim 8, wherein said communication module and said external computing device are in communication through a network or through synchronization via BLUETOOTH.

10. The system in accordance with claim 8, wherein said communication module and said external computing device are each individually configured for allowing bi-directional data transfer with a remote server.

11. A method of aiding in cessation of nicotine dependency comprising the steps of:

a) providing a nicotine cessation device comprising:
   i) a device housing including a plurality of pod receiving sockets, wherein each of said pod receiving sockets is spaced apart from one another;
   ii) a plurality of fluid pods, wherein each of said fluid pods has a first end and a second end, wherein said first end is removably coupled with a respective pod receiving socket of said plurality of pod receiving sockets, and wherein said second end is configured to be received between lips of a user of said nicotine cessation device;
   iii) a printed circuit board (PCB) mounted within said device housing and including a processor and a memory communicatively coupled to each of said plurality of pod receiving sockets; and
   iv) a power source mounted within said device housing and operably coupled to said PCB,
   wherein each respective fluid pod of said plurality of fluid pods is configured to receive a nicotine fluid having a predetermined concentration of nicotine therein,
   wherein each respective fluid pod receives a nicotine fluid concentration that is different than at least one other fluid pod, and
   wherein only said second end of one of said fluid pods of said plurality of fluid pods is available at a time to dispense vaporized nicotine fluid to said user;
b) allowing said user to inhale said vaporized nicotine fluid from a selected one of said fluid pods of said plurality of fluid pods;
c) detecting, via a selected pod receiving socket corresponding to said selected fluid pod, said selected fluid pod and said predetermined concentration of nicotine fluid in said nicotine fluid in said selected fluid pod;
d) measuring, via the selected fluid pod, one or more of:
   i) a duration of said inhale;
   ii) a draw force of said inhale;
   iii) a length of time between successive inhales and
e) calculating, via said processor, a nicotine intake for said inhale.

12. The method in accordance with claim 11, further comprising the steps of:

providing said nicotine cessation device with a communication module coupled to said PCB and configured for allowing bi-directional data transfer with an external computing device.

13. The method in accordance with claim 12, wherein said external computing device includes a second memory and a software application stored in said second memory, wherein said software application is configured to access a remote server.

14. The method in accordance with claim 13, wherein said communication module and said external computing device are in communication through a network or through synchronization via BLUETOOTH.

15. The method in accordance with claim 11, wherein each fluid pod comprises a pod housing configured to hold said nicotine fluid therein, wherein said first end includes a coil housing having a vaporizing coil communicatively coupled to said PCB and said power source, wherein each respective said second end defines at least one output opening therein, and wherein the method further comprises the steps of:

f) powering said vaporizing coil within said coil housing of said selected one fluid pod via said power source to vaporize the portion of said nicotine fluid whereby said vaporized nicotine fluid exits said fluid pod via said at least one output opening of said second end of said selected one fluid pod, wherein step f) occurs before step b).

16. The method in accordance with claim 15, wherein said second end of said fluid pod includes a capacitive sensor configured to be communicatively coupled to said PCB whereby said capacitive sensor communicates a signal to said PCB when said lips of said user engage said second end of said fluid pod.

17. The method in accordance with claim 15, wherein each said pod receiving socket on said device housing includes a pod receiving interface communicatively coupled to said PCB and said power source, wherein said pod receiving interface engages a corresponding contact on said first end of said fluid pod when said fluid pod is coupled to said pod receiving socket.

18. The method in accordance with claim 17, wherein said device housing includes a plurality of indicators, wherein each of said indicators is coupled to a respective pod receiving interface, and wherein said first end of each of said fluid pods includes a resistor sensible by said respective pod receiving interface and said PCB, wherein said resistor is indicative of said nicotine fluid concentration within said fluid pod, and whereby said respective indicator is selectively modulated to visually communicate said nicotine fluid concentration.

19. The method in accordance with claim 11, wherein said device housing further includes a vacuum sensor coupled to each of said pod receiving sockets whereby said sensor, in conjunction with said PCB, performs step d).

20. A system for aiding in the cessation of a nicotine dependency, the system comprising:

a) a nicotine cessation device comprising:
  a device housing including:
    i) a plurality of pod receiving sockets,
    ii) a printed circuit board (PCB) including a processor and a memory, and
    iii) a power source; and b) a plurality of fluid pods, wherein a respective fluid pod of said plurality of fluid pods is removably coupled with a respective pod receiving socket of said plurality of pod receiving sockets, wherein each respective fluid pod of said plurality of fluid pods is configured to receive a nicotine fluid having a predetermined concentration of nicotine therein, wherein each respective fluid pod receives said nicotine fluid having said predetermined nicotine fluid concentration that is different than said predetermined nicotine concentration of said nicotine fluid in at least one other fluid pod, wherein each fluid pod comprises a pod housing configured to hold said nicotine fluid therein, each fluid pod having opposing first and second ends, wherein said first end includes a coil housing communicatively coupled to said PCB and said power source, wherein said second end defines at least one output opening therein, whereupon powering of a vaporizing coil within said coil housing via said power source vaporizes said nicotine fluid whereby said vaporized nicotine fluid exits said fluid pod via said at least one output opening, wherein each said pod receiving socket on said device housing includes a pod receiving interface communicatively coupled to said PCB and said power source, wherein said pod receiving interface engages a corresponding contact on said first end of said fluid pod when said fluid pod is coupled to said pod receiving socket, and wherein said device housing includes a plurality of indicators, wherein a respective indicator is coupled to a respective pod receiving interface, and wherein said first end of each of said fluid pods includes a resistor sensible by said respective pod receiving interface and said PCB, wherein said resistor is indicative of said predetermined nicotine fluid concentration within said fluid pod and whereby said respective indicator is selectively modulated to visually communicate said predetermined nicotine fluid concentration.

21. A method of aiding in cessation of nicotine dependency comprising the steps of:

a) providing a nicotine cessation device comprising:
  i) a device housing including a plurality of pod receiving sockets;
  ii) a plurality of fluid pods;
  iii) a printed circuit board (PCB) mounted within the device housing and including a processor and a memory communicatively coupled to each of the plurality of pod receiving sockets; and
  iv) a power source mounted within the device housing and operably coupled to the PCB, wherein each respective fluid pod of said plurality of fluid pods is configured to receive a nicotine fluid having a predetermined concentration of nicotine therein, wherein each respective fluid pod receives said nicotine fluid having said predetermined nicotine fluid concentration that is different than said predetermined nicotine concentration of said nicotine fluid in at least one other fluid pod, wherein each fluid pod comprises a pod housing configured to hold said nicotine fluid therein, each fluid pod having opposing first and second ends, wherein said first end includes a coil housing having a vaporizing coil communicatively coupled to said PCB and said power source, wherein said second end defines at least one output opening therein, wherein each said pod receiving socket on said device housing includes a pod receiving interface communicatively coupled to said PCB and said power source, wherein said pod receiving interface engages a corresponding contact on said first end of said fluid pod when said fluid pod is coupled to said pod receiving socket, and wherein said device housing includes a plurality of indicators, wherein a respective indicator is coupled to a respective pod receiving interface, and wherein said first end of each of said fluid pods includes a resistor sensible by said respective pod receiving interface and said PCB, wherein said resistor is indicative of said predetermined nicotine fluid concentration within said fluid pod and whereby said respective indicator is selectively modulated to visually communicate said predetermined nicotine fluid concentration;

b) removably coupling a respective fluid pod of said plurality of fluid pods with a respective pod receiving socket of said plurality of pod receiving sockets;

c) powering said vaporizing coil within said coil housing via said power source to vaporize the portion of said nicotine fluid whereby said vaporized nicotine fluid exits said fluid pod via said at least one output opening, wherein step g) occurs before step c)

d) allowing a user to inhale a vaporized portion of a selected nicotine fluid from a selected fluid pod of said plurality of fluid pods;

e) detecting, via a selected pod receiving socket, the selected fluid pod and the predetermined nicotine fluid concentration of the selected nicotine fluid;

f) measuring, via the selected fluid pod, one or more of:
  i) a duration of the inhale;
  ii) a draw force of the inhale;
  iii) a length of time between successive inhales and g) calculating, via the processor, a nicotine intake for the inhale.

* * * * *